United States Patent [19]

Melcher et al.

[11] Patent Number: 4,493,732

[45] Date of Patent: Jan. 15, 1985

[54] METHOD FOR IMPLEMENTING PYRO-METALLURGICAL PROCESSES

[75] Inventors: Gerhard Melcher, Cologne; Wolfgang Wuth, Berlin, both of Fed. Rep. of Germany

[73] Assignee: Klöckner-Humboldt-Deutz AG, Fed. Rep. of Germany

[21] Appl. No.: 480,021

[22] Filed: Mar. 29, 1983

[30] Foreign Application Priority Data

Apr. 1, 1982 [DE] Fed. Rep. of Germany ..... 3212100

[51] Int. Cl.[3] ..... C22B 5/12

[52] U.S. Cl. ..... 75/24; 75/26; 75/74; 75/92

[58] Field of Search ..... 75/26, 24, 92, 23, 73, 75/74, 75; 266/172

[56] References Cited

U.S. PATENT DOCUMENTS 2,951,756 9/1960 Cavanagh ..... 266/172

4,168,157 9/1979 Lilja et al. ..... 75/26

4,180,251 12/1979 Jaquay ..... 266/172

4,326,702 4/1982 Queneau et al. ..... 75/26

*Primary Examiner*—M. J. Andrews

*Attorney, Agent, or Firm*—Hill, Van Santen, Steadman & Simpson

[57] ABSTRACT

A method and apparatus for implementing pyro-metallurgical processes, such as those involved in the reaction melting of fine grained solids or for the after-treatment of melts wherein an exothermically reacting solids/gas mixture is conducted through an acceleration jet as a heterogenous stream and is blown onto a melt contained in the furnace. The jet stream is ignited immediately upon discharge from the jet and a sharply focused or highly concentrated particle stream having a high surface power density (high mass flow velocity) and a high temperature is impacted against the melt. This results in the melt being subjected to localized intensive movement and is simultaneously heated. The method is suitable for the reaction melting of sulfidic or oxidic non-ferrous metal concentrates as well as for the reduction and/or depletion of non-ferrous metal containing slags, and for the reduction of metal melts.

6 Claims, 2 Drawing Figures

METHOD FOR IMPLEMENTING PYRO-METALLURGICAL PROCESSES

BACKGROUND OF THE INVENTION

1. Field of the Invention

The present invention relates to a method and apparatus for implementing pyro-metallurgical processes, such as the reaction smelting of fine grained solids wherein an exothermically reacting solids/gas mixture is conducted through an acceleration jet as a heterogenous stream and is blown onto the melt as a high mass velocity stream over a limited impingement area.

2. Description of the Prior Art

In a known method for the pyro-metallurgical treatment of fine grained solids with oxygen-rich gases and, if necessary, energy sources, there is employed a cyclone chamber wherein the solids are rendered molten at the prevailing temperature. The solids, the oxygen-rich gas, and the energy sources are mixed below the reaction temperature to form a suspension which is introduced into a vertical burning path with a velocity which suppresses flashback. The reaction commences there, and the suspension which predominantly contains molten or fusible particles is introduced into the cyclone chamber. Such a device operating along a horizontal axis is shown in German AS No. 22 53 074. A combustion temperature is reached at the end of the burning path, and arises from an equilibrium which occurs between the theoretical combustion temperature and the heat abstraction due to wall cooling of the burning path and the cyclone chamber. Gaseous and molten reaction products are separated by centrifugal forces upon entry into the cyclone chamber. The molten phase proceeds to the wall of the chamber in the form of a film. Since the wall is exposed to a high temperature load, it is protected from the outside by means of evaporation cooling whereby a coating of congealed melt is formed on the inside as a protective layer. As a result, heat is abstracted from the molten film. The molten film discharges from the cyclone chamber into a hearth in which a refining aftertreatment of the molten phases occurs. After passing through a device for separating dust and molten droplets, the gases and vapors are withdrawn for the purpose of recovering the metal oxides and thermal energy contained therein.

In the known method, the unavoidable cooling of the burning path and the cyclone chamber effects a reduction of the working temperatures both in the gaseous phase as well as in the molten phase bringing those temperatures below the theoretically attainable temperature levels. This is a disadvantage because high temperatures both in the melting process in the flame as well as in the reactions in the condensed phase are required to accomplish a thorough volatilization of the other metals as well as to prevent the formation of magnetite in the slag. Since only a very thin film of the molten phase flows over the wall regions of the cyclone chamber which are cooled to the solidification temperature, the melt reaches a temperature in the collecting chamber which necessarily lies below the level obtainable on the basis of the reaction temperature. Thus, an intensive mass transfer between molten particles with different reactions or oxidation conditions and the melt is not really possible, or is possible only to a slight degree because no significant bath motion occurs in the melt.

The relatively low temperatures of the various molten phases also has a disadvantage when it comes to their separation. Moreover, due to high oxidation, considerable magnetite formation can occur in the slag thereby inhibiting the reduction of the components in the metal and matte phases. This results in a relatively high metal content in the slag.

Relatively low reaction temperatures also have a disadvantage when it comes to volatilizing additional metals such as tin, zinc, antimony, arsenic, bismuth, germanium and the like. Consequently, these are only partially volatilized and remain as contaminants at levels which are too high with respect to the metal sought to be recovered.

In order to avoid such disadvantages, there has been a method proposed for continuous processing of nonferrous metal raw materials such as copper/zinc concentrates wherein the melt-down of the starting material is carried out in an atmosphere of a gas containing free oxygen. The reduction melting of the melt produced is carried out by means of a gas plasma flame having temperatures of 4000° to 5000° C. whereby the surface temperature of the melt is kept in the range from about 1500° to 1600° C. Such a process is described in German OS No. 26 55 397.

This plasma reduction melting method requires a very high outlay for apparatus and energy. The method is technically feasible but is not economically attractive.

Another known method for the continuous production of crude copper in a single stage from pyritic copper ore or concentrates consists in flash melting the same that so much oxygen or oxygen enriched air is fed into the reaction shaft with relation to the concentrate that the concentrate or ore in the reaction zone is greatly oxidized and a melt consisting only of crude copper and slag is formed below the reaction zone. This type of process is described in German AS No. 25 36 392.

There is a series of similar or related methods which address themselves to the difficult problem of directly converting pyritic ores directly into metal in a continuous process. An enumeration of a variety of such processes may be found, for example in U.S. Pat. No. 3,941,587. In this patent, it is stated that despite all efforts, none of the methods heretofore used has yielded a satisfactory solution to the problem of direct metal production.

The reasons for the negative experiences are partially explained by difficulties in process engineering but it can also be partially explained on the basis of the underlying thermodynamics. The chalcopyrite which is the most important copper ore mineral for extraction of copper may, for example, only be oxidized to such a degree that predominantly metallic copper and little copper oxide appear, whereas sulfur and iron should be as completely oxidized as possible at the same time. Together with the additives, iron proceeds into the slag phase, the residual sulfur proceeds into the sulfide matte phase, and metal is collected at the lowest location of the reactor vessel.

The kinetic properties of the previous methods, however, are still insufficient so that the ideal equilibrium state between the molten phases is not achieved. The slags contain too much copper oxide and magnetite because they are oxidized to too great a degree. The heavy, copper containing metal and matte phases are insufficiently oxidized; they still contain too much iron and sulfur. Because the conditions for mass transfer in the area of the melts are still inadequate, concentrations which deviate from the equilibrium state are not sufficiently compensated. Therefore, the current metallurgical methods of the prior art comprise additional work phases, i.e., the melt down is followed by a conversion under oxidizing conditions and the slag cleaning occurs under reducing conditions or by means of slag flotation.

SUMMARY OF THE INVENTION

The present invention provides a method and apparatus for the implementation of metallurgical processes which permits a thorough volatilization of volatiles and the production of a metal of high purity in one method step. For example, in copper production, purity of the molten metal should be such that it at least corresponds to the traditional converter quality and corresponds to anode quality copper if possible. Any improved method should be as energy efficient as possible and should be environmentally safe in terms of the amount and the composition of the exhaust gases.

The present invention can also be used to reduce melts, in particular, slag melts to deplete their metal contents. Thus, both iron (III) oxide content as well as the valuable metal oxide content consisting of, for example, lead oxide, zinc oxide, tin oxide, and others should be reduced. The new method thus represents an alternative feasible in terms of operating costs as compared with electric furnaces which are frequently employed for this purpose.

The method of the present invention provides a melting by means of high force and thermal transfer from a hot particle stream in accordance with the thermodynamic equilibrium conditions between the gas and the melt. The conversion between gas and solid particles occurs primarily in the region of the particle stream wherein particularly reaction-intensive conditions prevail as a result of the high surface power density and the high temperatures. The temperatures at the hottest location in the flame jet of the present invention lie in the range of about 2000° K. By producing a convective reaction system in the impact area where the particle stream meets the melt, the molten stream particles are absorbed by the melt and dissolved in accordance with equilibrium conditions. Thus, when melting down concentrates, the equilibrium associated distribution of the components contained in the concentrate particles to the melt phases being formed is of significant importance. The conditions in the slag reduction are similar, whereby both high iron (III) contents as well as valuable metal oxides can largely be removed from the slag by means of using coal dust in the particle stream thereby reducing the cost.

In accordance with the present invention, ignition of the particle stream occurs directly upon emergence of the stream from an accelerating jet and the reaction of gas and solids is thereby spontaneously started. This is in contrast with procedures in prior art wherein a combustible mixture emerging from the jet is self-ignitied by means of absorbing heat from the environment. However, in this type of system reaction time is lost. In the method of the present invention, the ignition of the stream directly upon emergence from the jet assures that the required reactions have occurred in the stream before its power has been emitted to the environment.

BRIEF DESCRIPTION OF THE DRAWINGS

The present invention is explained in greater detail by means of illustrations in the drawings in which.

DESCRIPTION OF THE PREFERRED EMBODIMENTS

Figure 1:
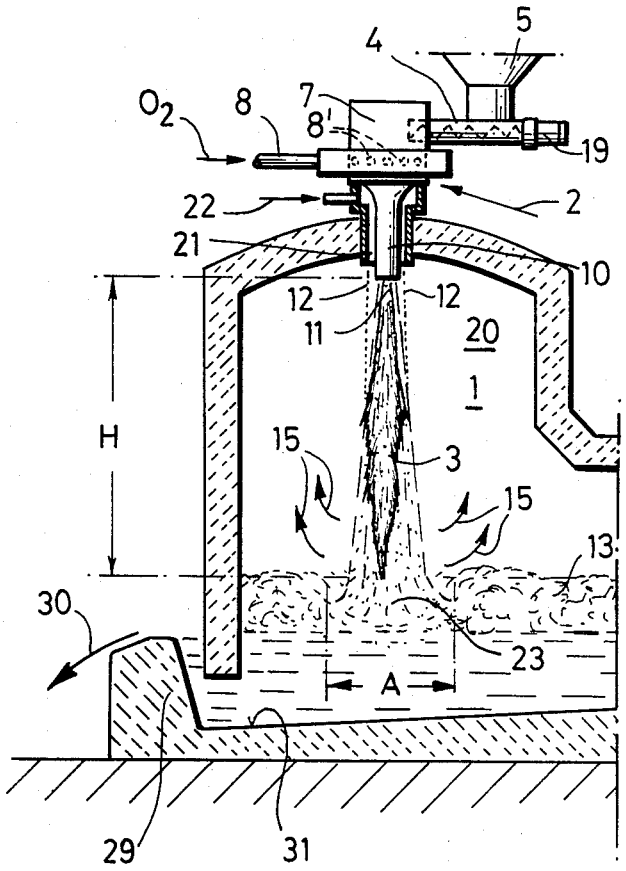
FIG. 1 illustrates a melting reactor for carrying out the method of the present invention partly in elevation and partly in cross section.

In order to produce a sufficiently dense particle stream, the density of the particle stream at the narrowest dimension of the jet should not fall significantly below 100 kg/m$^2$/sec in the case of melting down copper from concentrates. This density or particle mass velocity is a function of the idle pressure of the jet and of the solids/gas mass ratio which is calculated on the basis of the stoichiometry of the reaction.

In the case of direct copper production with oxygen utilizing 0.44 kg oxygen per kg chalcopyrite, and assuming a quiescent jet pressure of 10 bar, the density or mass flow velocity of the particle stream amounts to:

$$q_p = \frac{qg \cdot O_2}{0.44} = \frac{2.478}{0.44} = 5.626 \text{ kg} \cdot m^{-2} \cdot s^{-1}$$

The value qg is calculated according to known jet discharge equations.

Maintaining a high surface power density is also very important. In the case of reaction melting of copper, for example, this density should be on the order of 0.1 GJ·m$^{-2}$·s$^{-1}$ according to the reaction components required for this purpose and related to the cross section of the particle stream at its hottest location.

In another use of the present invention, the reduction and/or depletion of a slag melt containing valuable metals, the production of a reducing particle stream with coal and reaction gas is required. For reasons of stoichiometry, 5.80 kg air per kg coal dust are required. Therefore, the density of the particle stream for a 10 bar quiescent jet pressure amounts to:

$$q_p = \frac{qg,\text{air}}{5.80} = \frac{2,360}{5.80} = 407 \text{ kg} \cdot m^{-2} \cdot s^{-1}$$

The solids/gas mass ratio is thus determined by the stoichiometry of the reaction in the stream. This ratio is greater than 1 for oxidation and less than 1 for a reduction reaction.

In determining the diameter of the jet, in order to avoid blockages, the maximum particle size should not exceed certain maximum values depending on the jet diameter, the quiescent jet pressure, and on the material variables such as particle diameter and density, according to the following equation:

$$\dot{m}_p, \max \approx 2 \cdot D_D \cdot U_g^* \times \cdot d_p \cdot \rho_p [\text{kg} \cdot s^{-1}]$$

This maximum value, for example, amounts to approximately 1.8 kg·s$^{-1}$ for a copper concentrate utilizing a jet having a diameter of 20 mm. The term $d_p$ refers to the average grain size of the particles, and $\rho_p$ is the specific gravity of the particles. In this equation $U_g^*$ denotes the sound velocity of the heterogenous stream which is lower than the sound velocity of the reaction gas oxygen alone. It can be calculated according to known contexts and becomes smaller along with the solids/gas mass ratio.

Due to material, pulse and thermal transfer, the distance between the jet orifice and the bath depends on the force of the stream which is essentially a function of the precompression of the jet and the jet diameter. It differs for each reaction because of different solids/gas mass ratios due to differences in reaction stoichiometry. This distance can therefore range from about 0.5 to 3 m and is defined more precisely below in the examples given for different reaction systems.

From a dynamic point of view, the particle stream and melt form one system in which the desired reactions can favorably occur quickly and in accordance with equilibrium. The melt volume which can be placed in intensive motion by means of a lance and can be heated, is limited. It depends on the overall size of the particle stream/melt system which, moreover, is also defined by the spacing jet/bath and the existing stream force or power. Detailed values are more precisely defined in the subsequent examples. For example, higher stream forces are required in the melt treatment of metals than in treatment of slags.

The reaction melting of pyritic or sulfidic nonferrous metal concentrates is of significance particularly for the direct production of copper. This direct production cannot, however, be economically employed with known methods of the prior art because the copper losses in the slags are too high and also because of the inadequate purity of the crude copper produced.

Pyro-metallurgical direct production in a continuous, autogenous method provides a compact, uncomplicated structure of devices using the particle stream melting system of the present invention. The products of the process recovered in such manner can be processed further in traditional manners, for example, to recover copper by means of electrolysis, and slag by means of reduction. Even with complex concentrates, the copper produced according to the present invention does not contain more contaminants than occur with processes requiring more energy and being more injurious to the environment. This advantage occurs with the present invention because high volatilization rates of the volatilizable metals are accomplished in the particle stream because of the high temperatures, the large reaction surfaces, and because of the intensive mass transfer between gas and solids in the smallest possible space. Moreover, the dynamic behavior of the overall system enables both fast conversion as well as equilibrium-associated thermodynamic parameters such as temperature, concentrations, and partial pressures at the point of impact of the particle stream against the surface of the melt. It is possible for this reason to keep a relatively pure copper melt in equilibrium with a not excessively oxidized slag melt under a partial oxygen pressure of $10^{-6}$ through $10^{-7}$ bar and at a temperature of approximately 1700° K.

The slag can be aftertreated in a standard manner for reduction and for depletion, as by employing a particle stream of fine grained coal and air/oxygen mixture.

Referring now to the drawing figures, in FIG. 1 there is shown a melting reactor 1 of a known type in whose upper wall section there is provided a device 2 which produces a high pressure particle stream 3. The apparatus also includes elements such as a solids metering device 4 into which solids are fed by means of a feed hopper 5. A feeding and metering screw 19 is located at the discharge of the feed hopper 5. The screw conveys fine grained solids into a mixing chamber 7 into which oxygen under pressure is blown through openings 8' existing in an input line 8. The jet forces of the oxygen gas thereby generate an intimate turbulence with the solids whereby a mixing in the form of a solids-in-gas suspension is produced. This proceeds under the pressure of a few bar into an acceleration jet 10 which forms the particle stream 3 in a free space 20 of the reactor 1. The acceleration jet 10 is surrounded by an annular nozzle 21 which is connected to a supply line 22 for an ignition agent such as gas. An annular ignition flame 12 is situated at the discharge end 11 of the stream 3, the ignition flame 12 surrounding the stream 3 by means of an annular jacket and spontaneously igniting it. The burning particle stream in which the reaction processes and material conversion occur impacts a molten bath 13 in the impact area "A". The stream, loaded with molten particles, forms a dish-shaped impression 23 as a result of the jet force. An intense flow is formed below the impression, and a convective reaction system is thereby formed.

The distance between the discharge end 11 of the particle stream 3 and the surface of the melt 13 is referred to at letter "H". In the illustrated example, it amounts to approximately 2m. The width of the reactor 1 relative to its longitudinal direction can be such as to accept two or more devices 2 for the formation of particle streams 3 next to one another or, if necessary, behind one another as well.

The furnace structure includes an angular wall 29 and an inclined floor 31 which serve to provide a discharge opening for the melt as indicated by arrow 30.

Figure 2:
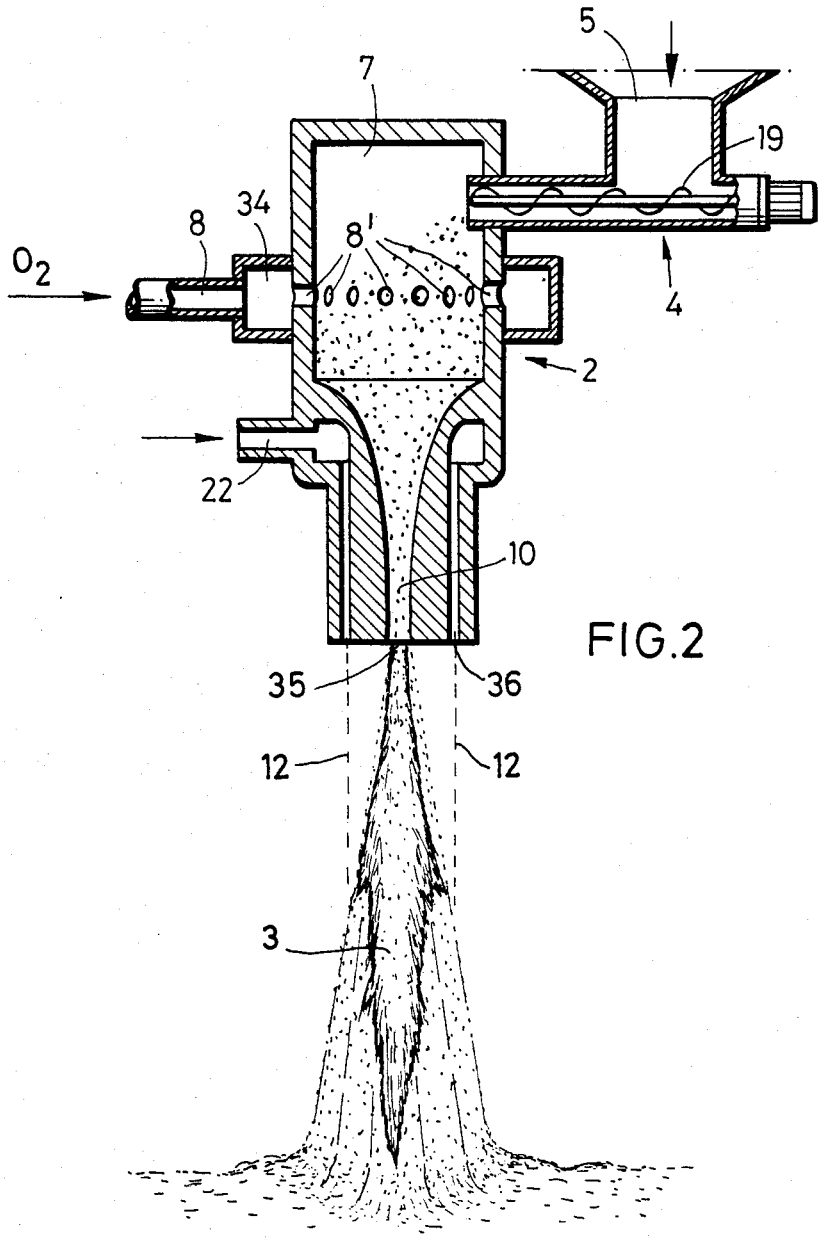
FIG. 2 is a cross-sectional view on a somewhat enlarged scale illustrating the mixing means and the acceleration jet with a surrounding ignition flame.

FIG. 2 illustrates a cross section through the device 2 for generating a particle stream. The solids metering unit 4 is equipped with a metering screw 19 which takes solids from the supply hopper 5 and introduces them into the mixing chamber 7 in a programmed amount per unit of time. The fine grained, dry solids are turbulently intermingled with oxygen gas which flows into the mixing chamber 7 under pressure from all sides through the nozzle-like openings 8' in the line 8 as well as the annular chamber 34. The gas/particle mixture forming a suspension in this manner proceeds from the mixing chamber 7 into the acceleration jet 10 and emerges at its lower opening 35 as a focused or concentrated particle stream 3. The acceleration jet 10 is surrounded by a cylindrical annular nozzle 21 in which a combustible ignition agent such as an ignition gas is introduced through a line 22. The ignition flame 12 which annularly surrounds the particle stream 3 thereby spontaneously sets it on fire at the discharge end 36 of the annular nozzle 21.

As the stream impacts the melt, it has sufficient force to create a convective reaction system having an intensive, topical bath motion in the impact area A of the stream against the melt. In the preferred form of the present invention, the spacing between the discharge end of the accelerator jet and the melt is between 0.5 and 3m, and the depth of the melt is at least one-half the diameter of the impact area of the particle stream on the melt. The particle stream is sufficiently sharply focused so that its angle of spread is not more than 16° and its diameter at its narrowest dimension is between 2 and 20 mm.

In the processes used in conjunction with the addition of slag-forming constituents and fine grained coal to the finely divided particles, the reaction gas containing at least 50% oxygen in an amount between 350 and 500 kg per 1000 kg of solids is employed.

The following example illustrates specific conditions for a particle stream melting system for the direct production of copper from sulfidic concentrates.

| | | |
|---|---|---|
| Particle Stream | | |
| Jet Diameter | $D_D$ | $= 20 \cdot 10^{-3}$ m |
| Quiescent Jet Pressure | p | = 10 bar |
| Mass Stream of the Gas | $\dot{m}_g$ | $= 0.78\ kg \cdot s^{-1}$ oxygen |
| Stream [or: jet] Power | K | = 295 N |
| Stoichiometric Factor of the Reaction | $\lambda_R$ | = 1.0 |
| Particle Mass Stream | $\dot{m}_p$ | $= 1.77\ kg \cdot s^{-1}$ chalcopyrite |
| Density of the Particle Material Stream | $q_p$ | $= 5{,}632\ kg \cdot m^{-2} \cdot s^{-1}$ |
| Temperature in the Stream | T | = 2,100 K |
| Spacing Jet/Bath | $H_D$ | = 2-3 m |
| Additive Material Stream | $\dot{m}_{pz}$ | $= 0.28\ kg \cdot s^{-1}\ SiO_2$ |
| Melt | | |
| Masses of the Melts (Molten Metal, molten matte, molten slag, related to a particle stream) | $\dot{m}_\Sigma$ | = 2,500 kg |
| Mean dwell time of the melts | $t_e$ | = 1,220 s (0.34 h) |
| Oxygen Conversion | $X_{O2}$ | = Approximately 100% |
| Crude Copper Throughput | $\dot{m}_{Cu}$ | $= 0.62\ kg \cdot s^{-1}$ (Approximately 16,000 tons per year) |
| Slag Throughput | $\dot{m}_{Schl}$ | $= 0.99\ kg \cdot s^{-1}$ (Approximately 25,700 tons per year) |
| $SO_2$ Throughput | $\dot{m}_{SO2}$ | $= 1.24\ kg \cdot s^{-1}$ (approximately 32,000 tons per year) |
| (Throughputs related to 300 Operating Days Per Annum) | | |

The products of the process produced according to this Example were an exhaust gas containing approximately 100% $SO_2$. A mixed oxide was produced corresponding to the volatilizable components in the concentrate. The nature of the slag produced depends on the nature of the additives. A crude copper containing approximately 99% Cu was produced, along with contaminations of

| | |
|---|---|
| S | 0.1% |
| Fe | 0.1% |
| O | 0.5% |
| Pb | 0.1% |
| As | 0.2% |
| Zn | 0.01% |
| Bi | 0.01% |

The process of the present invention can be used to improve yields and conserve energy through the use of a particle stream consisting of coal dust and air or an air/ oxygen mixture. The slag melt is intensively moved and heated by the hot reaction products of the partially burned out stream. The reaction products are nitrogen, carbon monoxide, and partially reacted coal particles. The coal particles thereby penetrate into the surface of the slag melt and the ash components of the coal are absorbed by the melt.

The following is an example of such a particle stream melting system which can be used for the volatilization of zinc and lead from a lead shaft kiln slag:

| | | |
|---|---|---|
| Particle Stream | | |
| Jet Diameter | $D_D$ | $= 2 \cdot 10^{-3}$ m |
| Quiescent Jet Pressure | p | = 10 bar |
| Mass Stream of the Gas | $m_g$ | $= 7.41 \cdot 10^{-3}\ kg \cdot s^{-1}$ air |
| Stream [or: jet] Force | K | = 3.95 N |
| Stoichiometric Factor of the Reaction | $\lambda_R$ | = 0.5 |
| Particle Mass Stream | $\dot{m}_p$ | $= 1.28 \cdot 10^{-3}\ kg \cdot s^{-1}$ |
| Density of the Particle Material Stream (Coal) | $q_p$ | $= 407\ kg \cdot m^{-2} \cdot s^{-1}$ |
| Temperature in the Stream | T | = 2,200 K |
| Distance Jet/ Bath | $H_D$ | = Approximately 0.5-1.0 m |
| Melt | | |
| Implant Mass of the Melt (per Particle Stream) | m | = 300 kg (Olivine slag) |
| Zinc Conversion from 10% to 0.5% | $X_{Zn}$ | = 95% |
| Lead Conversion from 2% to 0.05% | $X_{Pb}$ | = 98% |
| Discontinuous Operation: | | |
| Fusing [or: Melt] Time | t | = 10,800 × (3 hours) |
| Mass of the Required Fuel | $m_p$ | = 14 kg coal |
| Mass of Sublimated Zinc | $m_{Zn}$ | = 28.50 kg |
| Mass of Volatilized Lead | $m_{Pb}$ | = 5.85 kg |
| Continuous Operation: | | |
| Slag Throughput | $\dot{m}_{Schl.}$ | $= 0.15\ kg \cdot s^{-1}$ $(54\ kg \cdot h^{-1})$ |
| Zinc Volatilization | $\dot{m}_{Zn}$ | $= 14 \cdot 10^{-4}\ kg \cdot s^{-1}$ $(5.13\ kg \cdot h^{-1})$ |
| Lead Volatilization | $\dot{m}_{Pb}$ | $= 3 \cdot 10^{-4}\ kg \cdot s^{-1}$ $(1.05\ kg \cdot h^{-1})$ |

The products of this Example include an exhaust gas consisting of nitrogen and carbon monoxide, a mixed oxide with approximately 79% metal content, and a slag with 0.5% Zn and 0.05% Pb.

The employment of a high density particle stream containing the reactive components in essentially stoichiometric distribution is advantageous because of lower radiation losses and higher reaction intensity. Moreover, an increasing size of the particle suspension intensifies the force of the particle stream, thus promoting an active bath motion. With a constant particle stream density, the stream diameters should not be too low to secure the improved advantages of the present invention.

It will be evident that various modifications can be made to the described embodiments without departing from the scope of the present invention.

We claim as our invention:

1. A single step method for the pyrometallurgical treatment of finely divided particles of sulfidic and/or oxidic ore or concentrates with an oxygen-containing reactive gas which comprises:

mixing said particles and said reactive gas in substantially stoichiometric proportions under superatmospheric pressure in a mixing zone to form a pressurized suspension, passing said pressurized suspension through an acceleration nozzle at a confined molten bath, surrounding said suspension with an annular flame as it issues from said acceleration nozzle to spontaneously ignite said suspension and form a concentrated particle stream having an angle of spread not more than about 16°, and generating sufficient energy in said particle stream to induce convective currents in the molten bath where it is impacted by said particle stream.

2. A method according to claim 1 wherein the particle stream density at its narrowest location amounts to at least 100 $kg/m^2/sec$.

3. A method according to claim 1 wherein said particle stream has a heat flux density on the order of 0.1 $GJ/m^2/sec$ relative to the cross section of said stream at its hottest location.

4. A method according to claim 1 which includes the steps of:

adding slag-forming constituents and fine grained coal to the finely divided particles, and employing a reaction gas containing at least 50% oxygen in an amount between 350 and 500 kg per 1000 kg of solids.

5. A method according to claim 1 wherein the spacing between the discharge end of said acceleration nozzle and the melt is between 0.5 and 3 m, and the depth of the melt is at least one-half the diameter of the impact area of the particle stream in said melt.

6. A method according to claim 1 wherein the diameter of said particle stream at its narrowest dimension is between 2 and 20 mm.

* * * * *